US005508785A

United States Patent [19]

Takahashi et al.

[11] Patent Number: 5,508,785

[45] Date of Patent: Apr. 16, 1996

[54] IMAGE FORMING APPARATUS EQUIPPED WITH PROCESS CARTRIDGES

[75] Inventors: Kazunobu Takahashi, Nara; Takashi Makiura, Yamatotakada, both of Japan

[73] Assignee: Sharp Kabushiki Kaisha, Osaka, Japan

[21] Appl. No.: 456,067

[22] Filed: May 31, 1995

[30] Foreign Application Priority Data

Sep. 28, 1994 [JP] Japan ..... 6-232706

[51] Int. Cl.[6] ..... G03G 15/00

[52] U.S. Cl. ..... 355/200; 355/210

[58] Field of Search ..... 355/200, 210, 355/211; 347/138, 152

[56] References Cited

U.S. PATENT DOCUMENTS

| | | | |
|---|---|---|---|
| 4,866,482 | 9/1989 | Hirasawa et al. | 355/260 |
| 5,231,459 | 7/1993 | Jang et al. | 355/200 X |
| 5,276,479 | 1/1994 | Inomata | 355/200 |

FOREIGN PATENT DOCUMENTS 62-272283 11/1987 Japan .

*Primary Examiner*—Joan H. Pendegrass
*Assistant Examiner*—Sophia S. Chen
*Attorney, Agent, or Firm*—David G. Conlin; Brian L. Michaelis

[57] ABSTRACT

An image forming apparatus wherein the photosensitive unit is inserted through the common insertion port, first shafts are guided by the common guide path and the branching guide path, and the photosensitive unit is mounted at the mounting position with the protecting lever being retracting from the common guide path. When the developer unit is inserted through the common insertion port, second shafts and the third shafts are guided by the common guide path so that the developer unit is mounted at the predetermined mounting position. When the photosensitive unit is not mounted at the predetermined mounting position, the protecting lever shuts off the common guide path thereby blocking the movement of the developer unit to the predetermined mounting position.

5 Claims, 8 Drawing Sheets

IMAGE FORMING APPARATUS EQUIPPED WITH PROCESS CARTRIDGES

BACKGROUND OF THE INVENTION

1. Field of the Invention

The present invention relates to an image forming apparatus such as printing machine or copying machine having a plurality of process cartridges such as a photosensitive unit and a developer unit which can be attached to and detached from the main body of the apparatus.

2. Description of the Related Art

In printing machines and copying machines of the prior art wherein a plurality of process cartridges such as a photosensitive unit and a developer unit can be attached to and detached from the main body of the apparatus so that a user can easily service the apparatus including the replacement of the process cartridges, insertion ports and guide paths corresponding to the respective process cartridges have been provided on the main body of the apparatus in order to mount the process cartridges on the main body of the apparatus.

In the Japanese Patent Unexamined Publication No. 62-272283, a copying machine is disclosed wherein a photosensitive unit and a developer unit can be attached to and detached from the main body of the apparatus, and an insertion port for the photosensitive unit and an insertion port for the developer unit are arranged adjacent to each other on the main body of the apparatus.

However, because a plurality of insertion ports and guide paths for the insertion of process cartridges are provided on the main body of the apparatus in the prior art, it is necessary to give indication of the name of cartridge that can be inserted prevent the insertion port in order to prevent the insertion of a wrong cartridge. This has increased the manufacturing cost and required the user to make sure of the cartridge name indicated at the insertion port before inserting the cartridge, thus resulting in very poor operability.

SUMMARY OF THE INVENTION

Accordingly, an object of the present invention is to provide an image forming apparatus which can be more easily operated when mounting a plurality of process cartridges, which allows the user to easily recognize whether a cartridge is improperly mounted or no cartridge is mounted, and which is capable of preventing the process cartridges and the like from being damaged.

According to the invention, in an image forming apparatus having a plurality of process cartridges detachably housed in the main body of the apparatus is provided, a common cartridge insertion port for inserting the plurality of process cartridges and means for guiding the plurality of process cartridges inserted through the common insertion port to the respective mounting positions are provided in the main body of the apparatus.

In the image forming apparatus, the guiding means comprises a common guide path for guiding the plurality of process cartridges and at least one branching guide path that branches out of the common guide path and guides only one process cartridge.

The image forming apparatus may be constituted in such that means for preventing mis-mounting is provided for the purpose of, when at least one process cartridge is not mounted at the predetermined mounting position, shutting off the common guide path or the branching guide path thereby to prevent other process cartridges from moving to the predetermined mounting positions.

Preferably, the mis-mounting preventing means includes a protecting lever that is installed in the guiding means and freely shuts off the path.

Also, preferably, the image forming apparatus includes means for detecting whether or not a process cartridge is mounted at the predetermined mounting position.

Further, preferably, the image forming apparatus includes means for disabling the operation of the apparatus when a process cartridge is not mounted at the predetermined mounting position.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
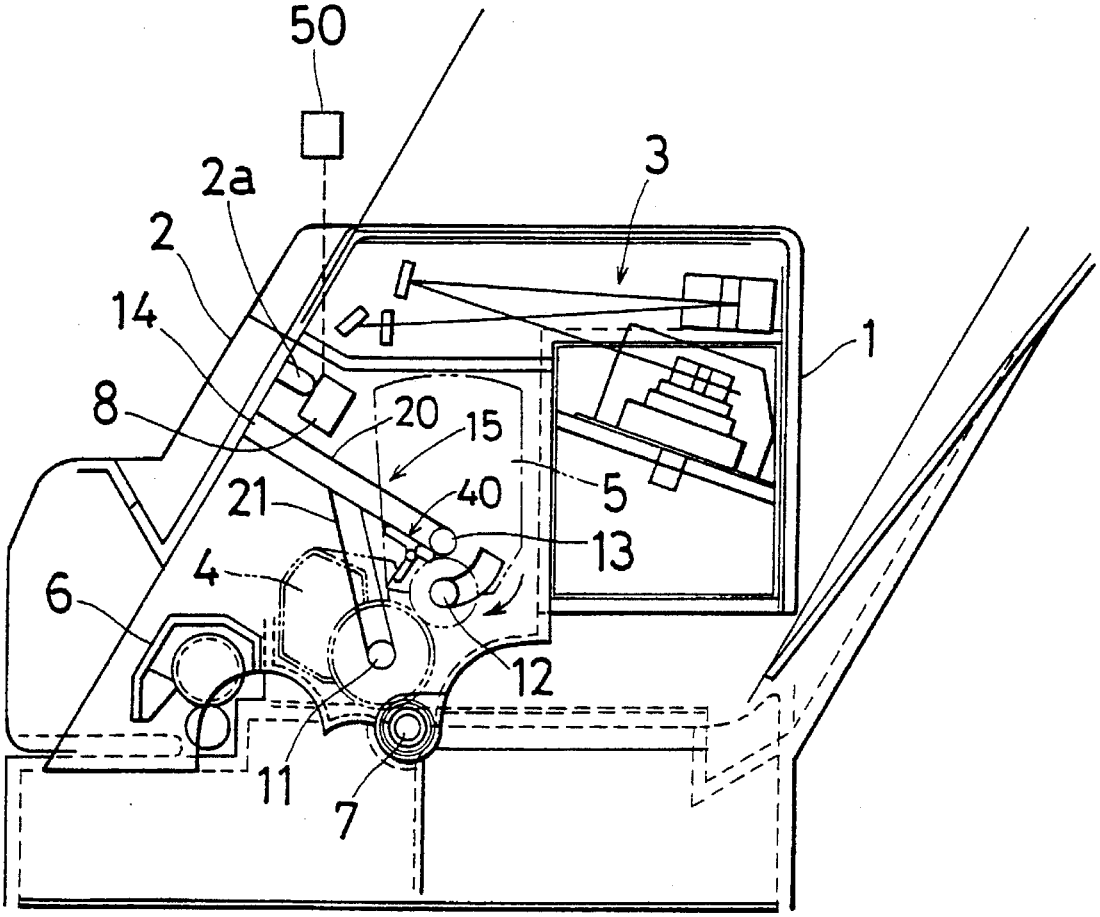
FIG. 1 is an overall view of a laser printer in cross-section according to an embodiment of the invention.

Now referring to the drawings, preferred embodiments of the invention are described below.

In the image forming apparatus according to the invention, as shown in FIG. 1, a plurality of process cartridges 4, 5 are housed detachably in the main body of the apparatus 1, while a common cartridge insertion port 14 for the insertion of the plurality of process cartridges 4, 5, and guiding means 15 for guiding the plurality of process cartridges 4, 5 inserted through the common insertion port 14 to respective predetermined mounting positions are provided in the main body of the apparatus 1.

The guiding means 15 comprises a common guide path 20 for guiding the plurality of process cartridges 4, 5 and a branching guide path 21 that branches out of the common guide path 20 for guiding only one process cartridge 4.

The image forming apparatus is also provided with mis-mounting preventing means for the purpose of, when at least one process cartridge 4 is not mounted at the predetermined mounting position, shutting off the common guide path 20 or the branching guide path 21 thereby to prevent the other process cartridge 5 from moving to the predetermined mounting position.

In the image forming apparatus of the invention, when one process cartridge 4 is inserted through the common insertion port 14, it is guided to the predetermined mounting position by the common guide path 20 or the branching guide path 21. When the other process cartridge 5 is inserted through the common insertion port 14 in case the process cartridge 4 is not mounted at the predetermined mounting position, the mis-mounting preventing means prevents the other process cartridge 5 from moving to the predetermined mounting position. At such time, operation of the apparatus is also disabled.

When the process cartridge 5 is inserted through the common insertion port 14 after the process cartridge 4 is mounted at the predetermined mounting position, the process cartridge 5 is guided to the specified mounting position without being prevented by the mis-mounting preventing means.

According to the invention, as will be clear from the above explanation, it is not required to give indication of the cartridge name at the insertion port of the main body of the apparatus corresponding to each cartridge as in the case of the prior art, and also it is not necessary to confirm the cartridge name indicated at the insertion port every time a cartridge is mounted, because a common insertion port is provided in the main body of the apparatus for the insertion of a plurality of process cartridges. Therefore, cost reduction and improvement of the operability are made possible.

Also because each cartridge is guided to the predetermined mounting position by the common guide path and the branching guide path which guides only one cartridge, each cartridge can be mounted easily and surely. Also the apparatus can be made smaller because a common space can be used for mounting all cartridges by providing the common insertion port and the common guide path.

Further, because mounting of other cartridges is prevented by the mis-mounting preventing means when at least one process cartridge 4 is not mounted at the predetermined mounting position, mis-mounting of a cartridge, mounting of cartridges in a wrong sequence and damage to the cartridges due to such mistakes can be prevented.

Now referring to the drawings, preferred embodiments of the invention are described in more detail hereinbelow.

The laser printer according to an embodiment of the invention has a front cover 2 which freely opens and closes and is installed at the front of the printer main body 1 as shown in FIG. 1. The printer main body 1 has an optical unit 3, a detachable process cartridge such as a photosensitive unit 4 having a photosensitive drum, a corona charger, a static eliminator, etc. and a developer unit 5 having a developer roller or the like, a fixing unit 6 and other components disposed therein. These constitute a Carlson process known to one skilled in the art. In FIG. 1, numeral 7 denotes a transfer roller and numeral 8 denotes a detector switch that senses departure or contact of a protrusion 2*a* of the front cover 2 and indicates whether the front cover 2 is open or closed.

Figure 2A:
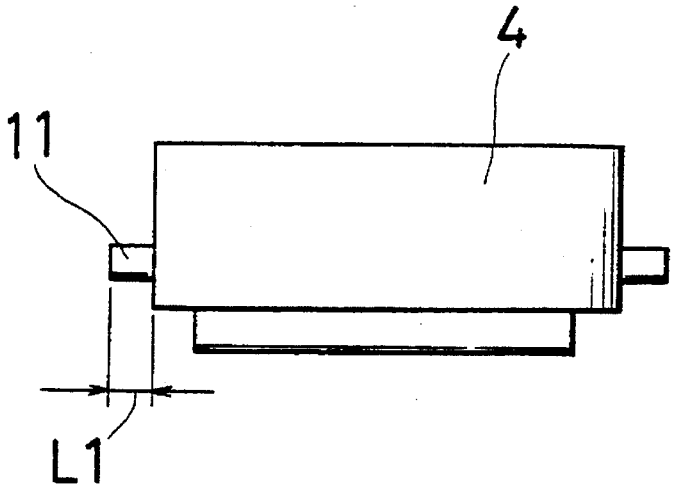
FIG. 2A is a plan view of a photosensitive unit.
Figure 2B:
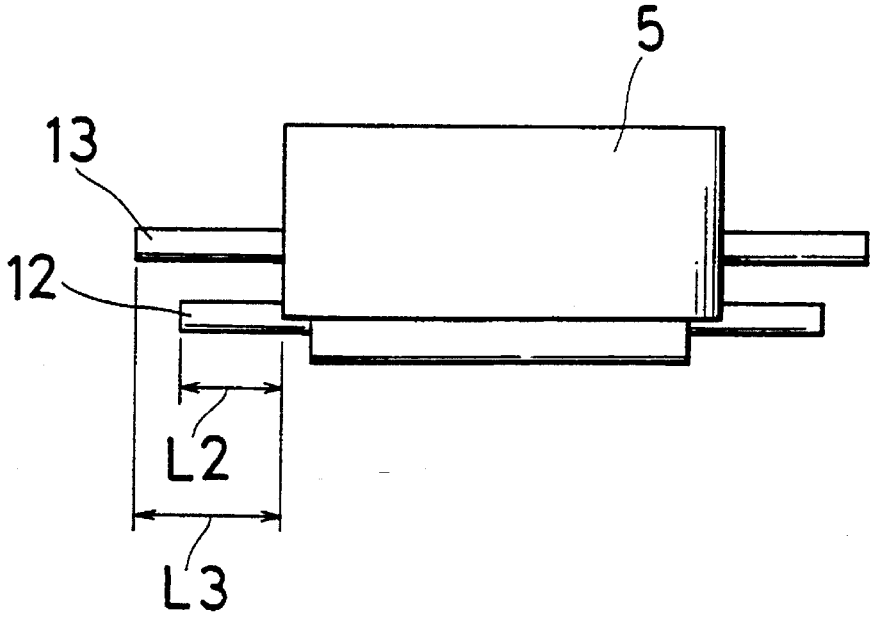
FIG. 2B is a plan view of a developer unit.

Installed on both side walls of the photosensitive unit 4 is a pair of first shafts 11 projecting in the longitudinal direction of the unit, as shown in FIG. 2A, and installed on both side walls of the developer unit 5 is a pair of second shafts 12 and a pair of third shafts 13 each projecting in the longitudinal direction of the unit, as shown in FIG. 2B. The first shafts 11, the second shafts 12 and the third shafts 13 have lengths in a relation of: first shaft 11 (L1)<second shaft 12 (L2)<third shaft 13 (L3).

Figure 3:
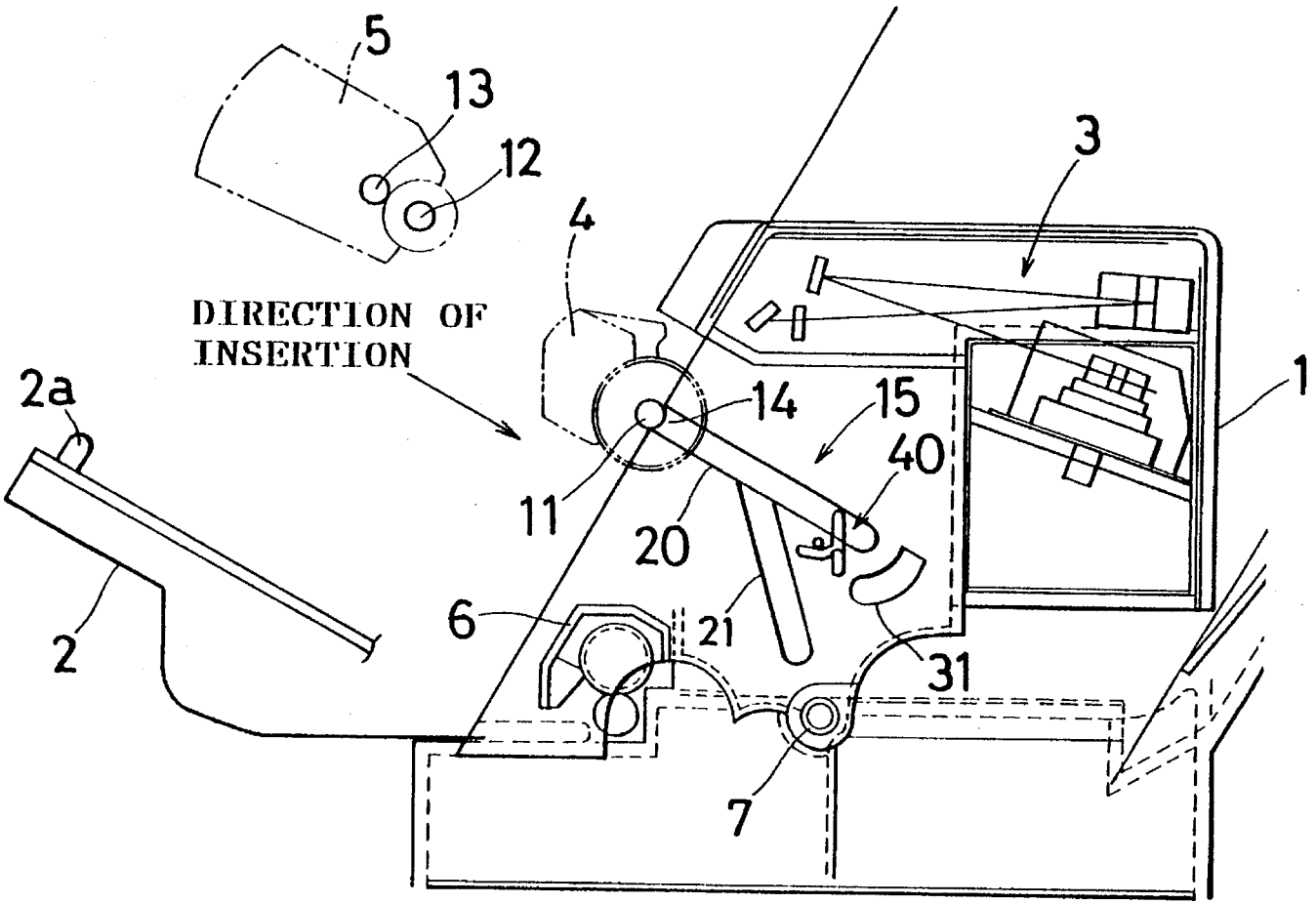
FIG. 3 is an overall view of the laser printer as seen before mounting the units.
Figure 4A:
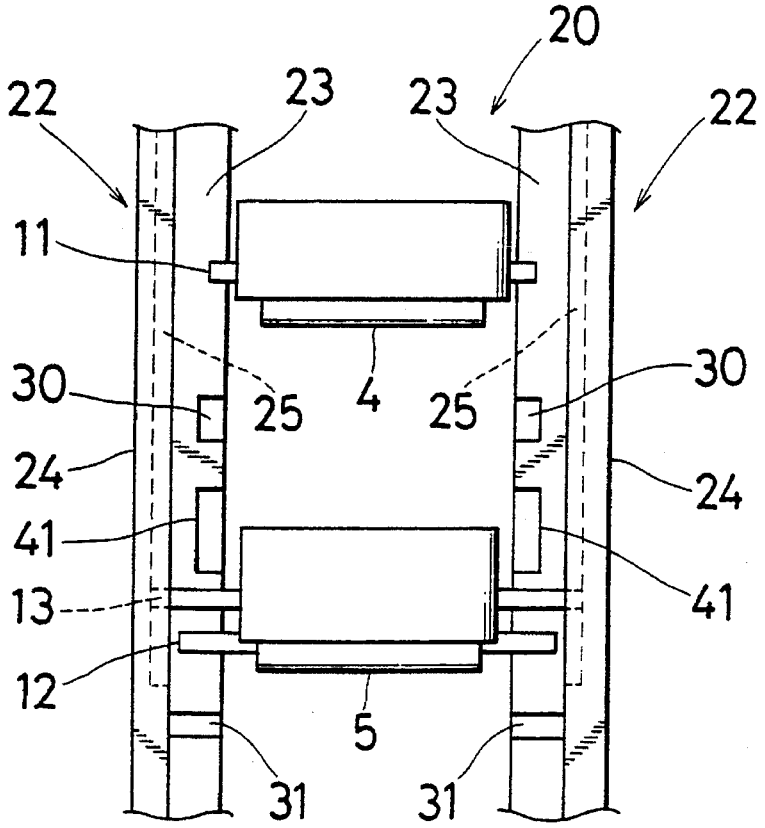
FIG. 4A is a plan view of a guide frame.
Figure 4B:
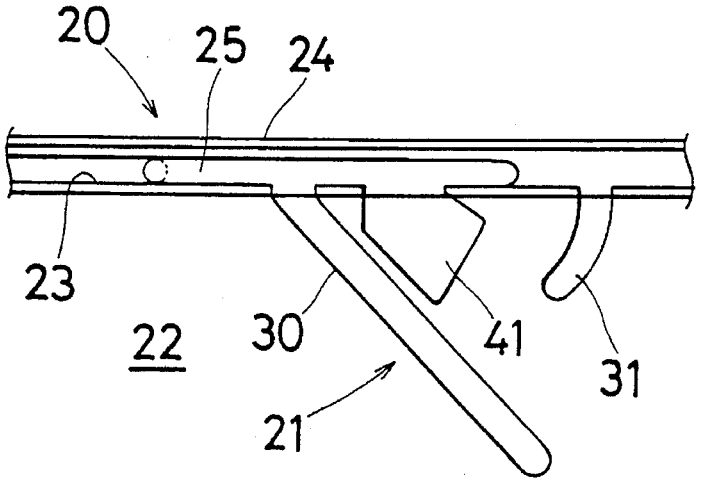
FIG. 4B is a side view of the guide frame.
Figure 5:
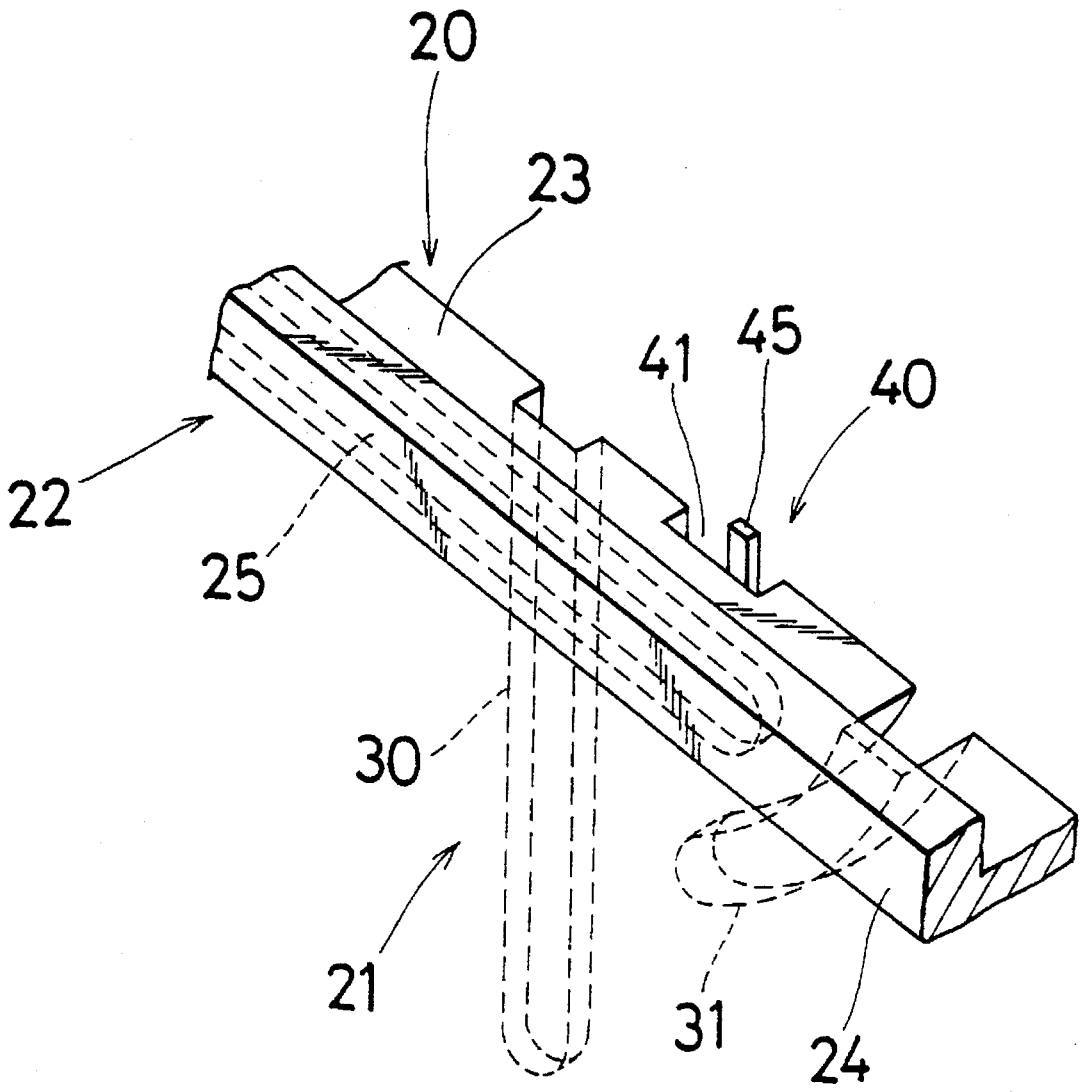
FIG. 5 is a perspective view of the guide frame.
Figure 6A:
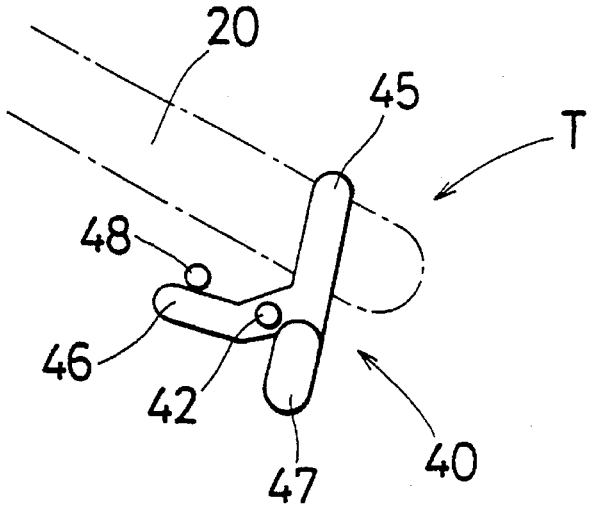
FIG. 6A is a side view of a protecting lever in a projected position.
Figure 6B:
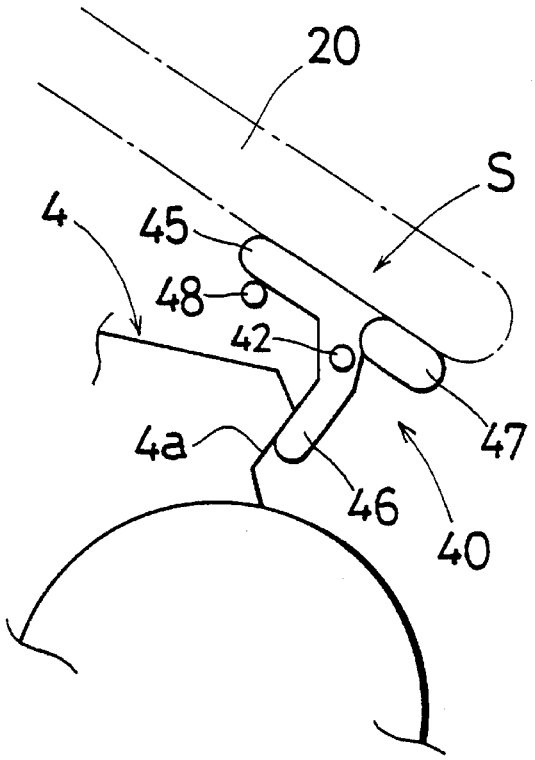
FIG. 6B is a side view of the protecting lever in a retracted position.

The printer main body 1 has a common cartridge insertion port 14 for the insertion of the photosensitive unit 4 and the developer unit 5 when mounting them, and guiding means 15 for guiding the photosensitive unit 4 and the developer unit 5 which have been inserted through the common insertion port 14 to the respectively predetermined mounting positions, as shown in FIG. 3. The common insertion port 14 is formed at the front of the printer main body 1, to allow the photosensitive unit 4 and the developer unit 5 to be inserted therethrough when the front cover 2 is opened.

The guiding means 15 comprises a common guide path 20 that guides all shafts 11, 12, 13 of the photosensitive unit 4 and the developer unit 5 and a branching guide path 21 that branches out of the common guide path 20 and guides only the first shaft 11 of the photosensitive unit 4 as shown in FIGS. 3, 4A, 4B and 5.

The common guide path 20 comprises a laterally disposed pair of guide rails 23 formed on the top of a laterally disposed pair of guide frames 22 which are arranged within the printer main body 1. The guide rails 23 are inclined downward from the front to the rear of the printer main body 1. Installed outside of the guide rails 23 are respective side walls 24 being erected thereon, while guide grooves 25 are formed on the inner surfaces of the side walls 24 to guide the third shafts 13 of the developer unit 5. The guide grooves 25 continuously join, at the starting end thereof, with the common insertion port 14 and is formed in arc shape at the terminating end thereof. The pair of guide frames 22 are disposed in parallel with each other and are separated at a distance slightly longer than the longitudinal lengths of the photosensitive unit 4 and the developer unit 5, so that the guide frames 22 enable it to guide the photosensitive unit 4 and the developer unit 5 with substantially no lateral deviation.

The branching guide path 21 comprises slant grooves 30 formed on the inside of the right and left guide frames 22. The slant grooves 30 are inclined downward from the front to the rear of the printer main body 1 at an angle steeper than that of the guide rails 23, while continuously joining at the starting end thereof with the guide rails 23 and being formed in arc shape at the terminating end thereof. The distance between the right and left slant grooves 30 is larger than the length across both ends of the first shafts 11 of the photosensitive unit 4, and is smaller than the length across both ends of the second shaft 12 of the developer unit 5, so that the slant grooves 30 are capable of guiding only the first shafts 11 of the photosensitive unit 4. When the first shafts 11 of the photosensitive unit 4 have been guided to the terminating end of the slant grooves 30, the photosensitive unit 4 enters a state of being positioned at the predetermined mounting position.

Because the photosensitive unit 4 is guided by the branching guide path 21, only the developer unit 5 is guided by the common guide path 20 that is at the back side of the printer main body 1 further than the branching guide path 21, thus providing for a function like a branching path.

Also provided at the back side of the printer main body 1 further than the branching guide path 21 are arc grooves 31 being formed on the inside of the right and left guide frames 22, through which the second shafts 12 pass when the developer unit 5 is rotated in the direction of an arrow shown in FIG. 1 about the third shafts 13 which have been guided to the terminating end of the guide grooves 25. The arc grooves 31 are bent downward from the rear to the front of the printer main body 1, while continuously joining at the starting end thereof with the guide rails 23 and being formed in arc shape at the terminating end thereof. When the third shafts 13 of the developer unit 5 reach the terminating end of the arc groove 31, the developer unit 5 enters a state of being positioned at the predetermined mounting position.

Further, mis-mounting preventing means is provided so that, when the photosensitive unit 4 is not mounted at the predetermined mounting position, the common guide path 20 is shut off thereby to prevent the developer unit 5 from moving to the predetermined mounting position. The mis-mounting preventing means comprises a protecting lever 40 arranged freely rotatably in recesses 41 formed between the slant grooves 30 and the arc grooves 31 of the right and left guide frames 22 as shown in FIGS. 1, 5, 6A, 6B, and can be freely switched either to a projecting position T wherein the protecting lever 40 project from the right and left guide rails 23 or to a retracted position S wherein the protect lever 40 is retracted from the guide rails 23.

The protecting lever 40 is supported freely rotatably by a support shaft 42 which is fixed on the guide frame 22, and has a shut-off piece 45 which can be freely projected from the recess 41 over the guide rail 23, a contact piece 46 which is disposed in a direction perpendicular to the shut-off piece 45 and makes contact with a rib 4*a* located at the top of the photosensitive unit 4 when the first shafts 11 of the photosensitive unit 4 are guided by the branching guide path 21, and a weight piece 47 which is disposed on the side opposite to the shut-off piece 45 with respect to the support shaft 42. The contact piece 46 is formed to project inward in order to make contact with the photosensitive unit 4 possible. The protecting lever 40 is constituted in such a way that, when the photosensitive unit 4 is not mounted or the first shafts 11 are not guided to the terminating end of the branching guide path 21, the shut-off piece 45 projects over the guide rail 23 into the projecting position T due to the weight of the weight piece 47 and, when the first shafts 11 of the photosensitive unit 4 are guided to the terminating end of the branching guide path 21, the contact piece 46 is forced downward by the rib 4*a* of the photosensitive unit 4 thereby to cause the shut-off piece 45 to be housed in the recess 41 in the retracted position S. The weight piece 47 may be replaced with a spring, interposed between the protecting lever 40 and each of the guide frames 22, which biases the protecting lever 40 in the direction of the projecting position T.

The right and left guide frames 22 are provided with a stopper 48 fixed thereon which make contact with the contact piece 46 when the protecting lever 40 is in the projecting position T in order to regulate the rotation of the protecting lever 40. The stopper 48 is made in such a size that does not contact with the rib 4*a* of the photosensitive unit 4 when the first shafts 11 of the photosensitive unit 4 are guided by the branching guide path 21, and is housed in the recesses 41.

Figure 7:
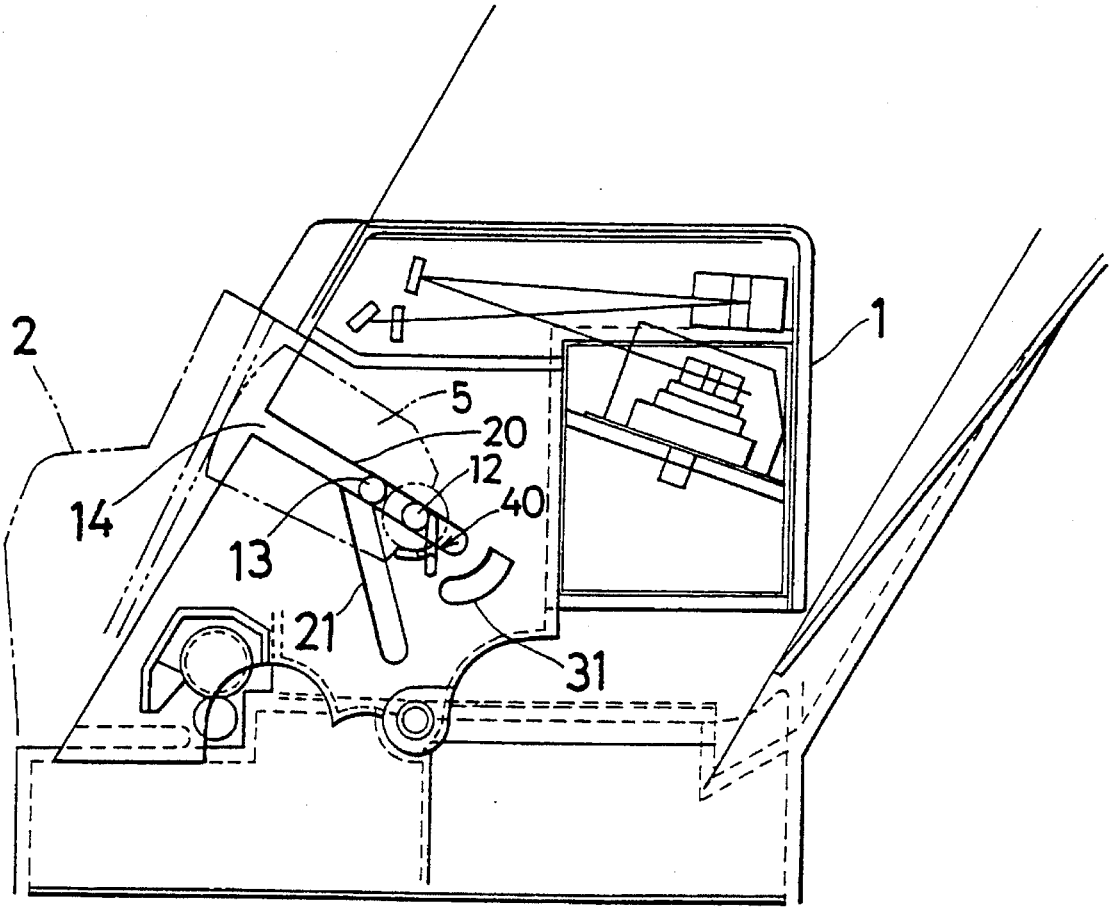
FIG. 7 is an overall view of the laser printer in cross-section as seen when mounting of the developer unit is prevented.
Figure 8:
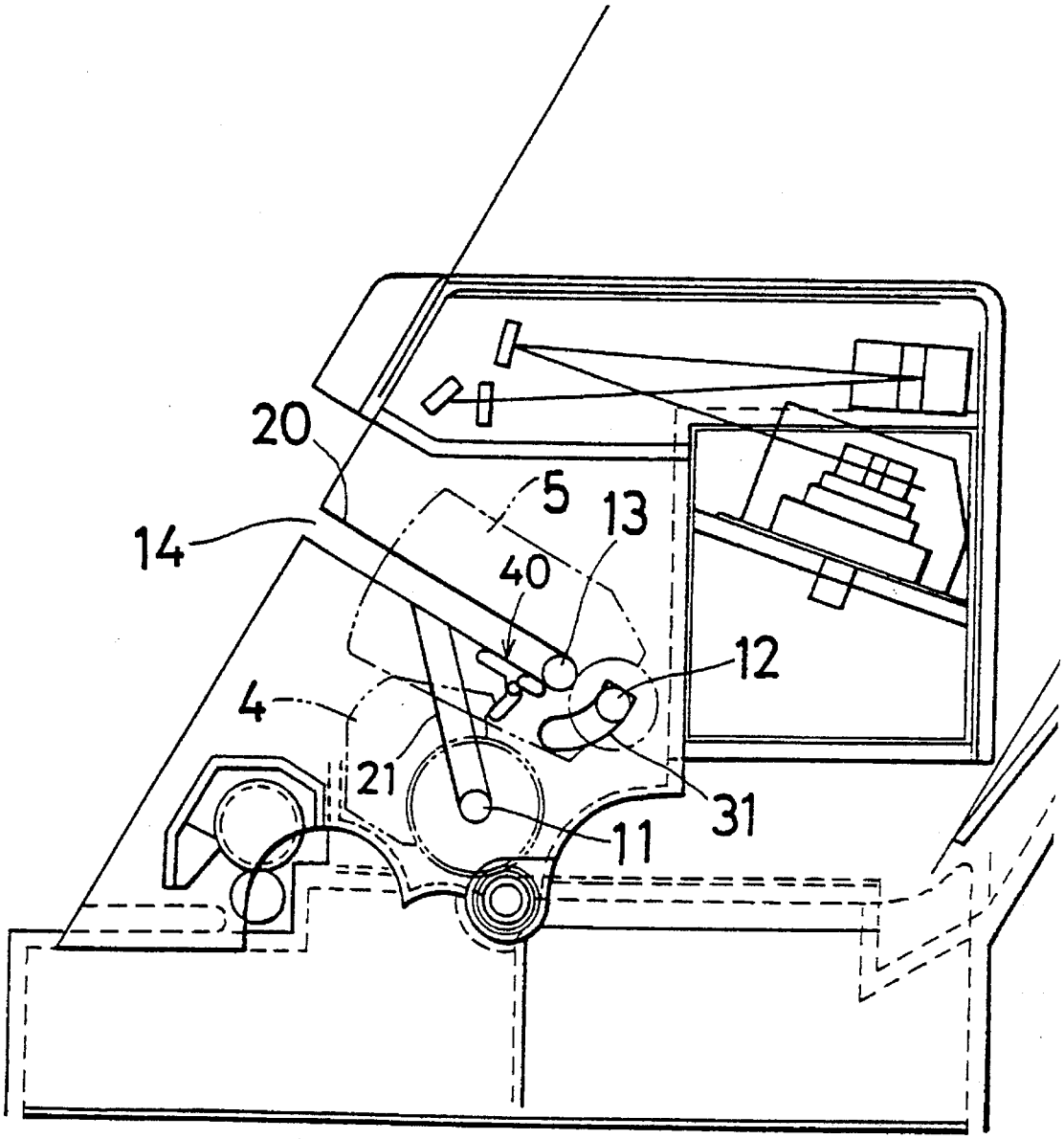
FIG. 8 is an overall view of the laser printer in cross-section as seen when a second shaft of the developer unit is guided up to a terminating end of a guide groove.

When the second shafts 12 of the developer unit 5 make contact with the protecting lever 40 in the projecting position T so that the developer unit 5 is prevented to move, part of the developer unit 5 comes out of the common insertion port 14 as shown in FIG. 7 making it impossible to close the front cover 2. Because the detector switch 8 outputs an open signal when the front cover 2 cannot be closed, mounting of the photosensitive unit 4 and the developer unit 5 at the predetermined mounting positions can be detected through the output signal of the detector switch 8. Also even when the photosensitive unit 4 is mounted at the predetermined mounting position and the developer unit 5 is not mounted at the predetermined mounting position as shown in FIG. 8, mounting of the photosensitive unit 4 and the developer unit 5 at the predetermined mounting positions can be surely detected by making the front cover 2 unable to close or by providing sensors or the like that detect the photosensitive unit 4 and the developer unit 5 being mounted at the predetermined mounting positions, aside from the detector switch 8.

Also provided is control means 50 that disables operation of the apparatus when the front cover 2 is open, namely based on the open signal from the detector switch 8. The control means 50 consists of a microcomputer to which input devices such as the detector switch 8 and output devices such as display and drive unit are connected.

In the above configuration, when the front cover 2 is opened and the photosensitive unit 4 is inserted through the common insertion port 14, the first shafts 11 of the photosensitive unit 4 slide over the guide rails 23 to be guided by the common guide path 20. When the first shafts 11 reach the starting end of the slant grooves 30, weight of the photosensitive unit 4 causes the first shafts 11 to be transferred to the slant grooves 30 and guided by the branching guide path 21. At this time, the rib 4*a* of the photosensitive unit 4 comes into contact with the contact piece 46 of the protecting lever 40 in the projecting position T, so that the contact piece 46 is forced downward as the photosensitive unit 4 moves, thereby making the protecting lever 40 to rotate. When the first shafts 11 reach the terminating end of the slant grooves 30 and the photosensitive unit 4 is positioned at the predetermined mounting position, the shut-off piece 45 is housed in the recess 41 and the protecting lever 40 is retracted from the guide rail 23, namely the common guide path 20, into the retracted position S, thereby enabling the mounting of the developer unit 5.

In case the developer unit 5 is inserted through the common insertion port 14 when the first shafts 11 of the photosensitive unit 4 have not been properly inserted up to the terminating end of the slant grooves 30 or when the photosensitive unit 4 is not mounted, the second shafts 12 of the developer unit 5 come into contact with the shut-off piece 45 in the common guide path 20, because the shut-off piece 45 of the protecting lever 40 is in the projecting position T wherein it projects over the guide rail 23, and therefore, the protecting lever 40 is in contact with the photosensitive unit 4 or the stopper 48 and is regulated with respect to the rotation thereof, so that the developer unit 5 is prevented from moving to the predetermined mounting position.

At this time, part of the developer unit 5 comes out of the common insertion port 14 as shown in FIG. 7, causing the front cover 2 to be unable to close so that the detector switch 8 senses that the front cover 2 is opened, thereby making the apparatus inoperable.

When the developer unit 5 is inserted through the common insertion port 14 after the photosensitive unit 4 has been properly mounted at the predetermined mounting position, the second shafts 12 of the developer unit 5 slide over the guide rails 23 and the third shafts 13 are guided by the guide grooves 25, so that the developer unit 5 is guided by the guide path 20. Even when the second shafts 12 and the third shafts 13 reach the starting end of the slant grooves 30, the second shafts 12 and the third shafts 13 are guided by the common guide path 20 without changing the course because their lengths are longer than the distance across the slant grooves 30. When the third shafts 13 reach the terminating end of the guide grooves 25 as shown in FIG. 8, the second shafts 12 reach the starting end of the arc groove 31 and the developer unit 5 is rotated around the third shafts 13 so that the second shafts 12 move to the terminating end of the arc grooves 31. At this time, the developer roller comes into contact with the photosensitive drum while maintaining an appropriate pressure, thereby positioning the developer unit 5 at the predetermined mounting position. Then, when the front cover 2 is closed, the apparatus is enabled to operate.

Because the common insertion port 14 is provided in the printer main body 1 for the insertion of the photosensitive unit 4 and the developer unit 5, as described above, it is not necessary to indicate the cartridge name at the insertion port of the printer main body corresponding to each cartridge as in the case of the prior art, and also it is not necessary to make sure of the cartridge name at the insertion port every time a cartridge is mounted, and therefore it is made possible to cut down the cost and improve the operability.

Also because the units 4, 5 are guided by the common guide path 20 and the branching guide path 21 to the predetermined mounting position, the units 4, 5 can be mounted easily and surely. Moreover, the apparatus can be made smaller by providing the common insertion port 14 and the common guide path 20 and using the common space for mounting the units 4, 5.

Further, when the photosensitive unit 4 is not properly mounted at the predetermined mounting position or the photosensitive unit 4 is not mounted at all, the protecting lever 40 prevents the developer unit 5 from being mounted, making it possible to prevent mis-mounting of the photosensitive unit 4, wrong sequence of mounting the units 4, 5 and damage to the units 4, 5 due to these mistakes.

In addition, because blocking of mounting of the developer unit 5 causes part of the developer unit 5 to come out of the common insertion port 14, making it impossible to close the front cover 2, mis-mounting of the photosensitive unit 4 and wrong sequence of mounting can be easily detected with a simple configuration. Also, because the apparatus is made inoperable when the front cover 2 is opened, this prevents damage to the apparatus as well as to the units 4, 5 that would be caused by the operation of the apparatus with abnormal mounting of the units 4, 5.

The invention is not limited to the above embodiment, and various corrections and modifications can of course be made to the above embodiments within the spirit and scope of the invention. For example, the first shafts 11 of the photosensitive unit 4 and the second shafts 12 and the third shafts 13 of the developer unit 5 may be changed in width and shape thereof so that the branching guide path 21 guides only the first shafts 11, or protrusions or the like may be formed instead of the first shafts 11, the second shafts 12 and the third shafts 13. Further, the detachable process cartridges are not limited to the photosensitive unit 4 and the developer unit 5, but other units may be used as the process cartridges, and the photosensitive unit 4 may be mounted after the developer unit 5. Furthermore, the mis-mounting preventing means may also be made in such a configuration that a solenoid, a motor or the like is driven based on an output signal from a detector switch that senses whether or not the photosensitive unit 4 is mounted at the predetermined mounting position, thereby operating a member that shuts off the guide path.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus including a plurality of process cartridges detachably house in a main body thereof, the apparatus comprising:

a common cartridge insertion port for inserting a plurality of process cartridges; and means for guiding the plurality of the inserted process cartridges to respective mounting positions thereof, both the common cartridge insertion port and the guiding means being provided in the main body of the apparatus, and further wherein the guiding means comprises a common guide path for guiding the plurality of process cartridges and at least one branching guide path that branches out of the common guide path and guides only one process cartridge.

2. The image forming apparatus according to claim 1, further comprising means for preventing mis-mounting of the process cartridges, capable of shutting off the common guide path or the branching guide path, when at least one process cartridge is not mounted at a predetermined mounting position, thereby to prevent other process cartridge(s) from moving to a predetermined mounting position.

3. The image forming apparatus according to claim 2, wherein the mis-mounting preventing means includes a protecting lever that is installed in the guiding means and freely shuts off the guide path.

4. The image forming apparatus according to claim 2, still further comprising means for detecting whether or not a process cartridge is mounted at the predetermined mounting position.

5. The image forming apparatus according to claim 4, still further comprising means for disabling the operation of the apparatus when any of process cartridges is not mounted at the predetermined mounting position.

* * * * *